US007059160B2

(12) United States Patent
Keller

(10) Patent No.: US 7,059,160 B2
(45) Date of Patent: Jun. 13, 2006

(54) ROTARY LOCKING CYLINDER FOR A SAFETY LOCK

(76) Inventor: Ernst Keller, untere Schwandenstrasse 22, CH-8805, Richterswill (CH)

( * ) Notice: Subject to any disclaimer, the term of this patent is extended or adjusted under 35 U.S.C. 154(b) by 82 days.

(21) Appl. No.: 10/181,900

(22) PCT Filed: Jan. 9, 2001

(86) PCT No.: PCT/CH01/00014

§ 371 (c)(1),
(2), (4) Date: Jul. 24, 2002

(87) PCT Pub. No.: WO01/53638

PCT Pub. Date: Jul. 26, 2001

(65) Prior Publication Data

US 2004/0003634 A1 Jan. 8, 2004

(30) Foreign Application Priority Data

Jan. 24, 2000 (CH) ..... 130/00

(51) Int. Cl.
*E05B 9/04* (2006.01)

(52) U.S. Cl. ..... 70/375; 70/379 R; 70/453; 70/461

(58) Field of Classification Search ..... 70/379 R, 70/380, 409, 493, 375, DIG. 60, 423–424, 70/427–428, 453–454, 367, 461, 372
See application file for complete search history.

(56) References Cited

U.S. PATENT DOCUMENTS 3,293,892 A * 12/1966 Falk ..... 70/493
3,824,818 A * 7/1974 Neale ..... 70/358
3,974,671 A * 8/1976 Rossetti ..... 70/375
4,195,504 A * 4/1980 Foshee ..... 70/369
4,603,566 A * 8/1986 Kruehn et al. ..... 70/380
5,479,801 A 1/1996 Keller
5,666,835 A * 9/1997 Keller ..... 70/397
5,839,305 A * 11/1998 Aston ..... 70/283.1
6,058,752 A * 5/2000 Feder ..... 70/419
6,532,781 B1 * 3/2003 Keller ..... 70/358

FOREIGN PATENT DOCUMENTS

CH 281 686 3/1952
DE 86 33 108 U 4/1988
DE 4213382 A1 * 7/1993

(Continued)

OTHER PUBLICATIONS

First page only for HU 125863 B (Jan. 26, 1940).

(Continued)

*Primary Examiner*—Brian E. Glessner
*Assistant Examiner*—Christopher Boswell
(74) *Attorney, Agent, or Firm*—Browdy and Neimark, PLLC

(57) ABSTRACT

The rotary locking cylinder comprises a housing (5) and at least one rotor (8) provided with a key channel (27). Tumblers are provided to rotationally release the armature (8) with a key (17) associated therewith. A driver (6) is provided with at least one extension element (3) on the active part (2) of the rotary cylinder. Said extension element comprises a housing (24) and a rotatable insert (9). At least one extension element (3) is arranged on an outer side on the active part (2) at a distance from the driver (6). The key shank is extended in a manner which corresponds substantially to the length (A) of the extension element (3). Preferably, the rotatable insert (9) of the extension element (3) is profiled.

16 Claims, 3 Drawing Sheets

FOREIGN PATENT DOCUMENTS

| | | | |
|---|---|---|---|
| EP | 787872 A1 | * | 8/1997 |
| EP | 0 874 113 | | 10/1998 |
| WO | WO 99/54574 | * | 10/1999 |

OTHER PUBLICATIONS

First page only for HU 215375 B (Dec. 28, 1998).

* cited by examiner

ROTARY LOCKING CYLINDER FOR A SAFETY LOCK

BACKGROUND OF THE INVENTION

TECHNICAL FIELD OF THE INVENTION

This invention relates to a rotary locking cylinder for a safety lock, with a housing and at least one armature having a key channel, with tumblers which are provided to rotationally release the armature with an associated key, with a driver and with at least one extension element arranged on the active part of the rotary locking cylinder.

PRIOR ART

Rotary locking cylinders of this type are known in general. They can be double locking cylinders or single cylinders. Double locking cylinders can be operated from both sides, whereas single rotary locking cylinders can be operated from one side only. Such rotary locking cylinders can be manufactured with a very degree of high locking security and are particularly suited to the construction of locking units.

To adapt these to different thicknesses of doors and windows, for example, it is known to extend the active part of the rotary locking cylinder by adding on extension elements. Here the extension elements are added in on both sides of the driver and accordingly the active part is moved away from the driver outwardly in both directions.

The active part is that part which is equipped with tumblers. The extension elements on the other hand have no tumblers and are thus not effective in locking. The associated keys do not have to be changed when such an extension is utilised. The keys thus always have the same length, independent of the length of the locking cylinder.

OBJECT AND SUMMARY OF THE INVENTION

The inventor has created the task of providing a rotary locking cylinder of the abovementioned type, which shows added improvements in terms of safety technology and which can be manufactured cost-effectively nevertheless.

This task is solved using a rotary locking cylinder of this type by the extension element being attached at a distance from the driver on the outside on the active part and by the key shank being extended substantially in correspondence with the length of this extension element. With known rotary locking cylinders the active part always sits on the grip side after addition of an extension element. By comparison, in the case of the rotary locking cylinder according to the present invention in terms of safety technology the active part sits on the protected side. If an attempt is made to drill through the rotary locking cylinder for example, then the extension element must be drilled through first. To effectively block this the extension element can easily be designed on the grip side, such that it cannot be drilled through. Whenever an attempt is made to twist off or strip the rotary locking cylinder at the protruding end, essentially only the extension element is damaged, and not the active part. Also, if a protruding end is shorn off using a chisel this still does not result in releasing the lock, because in this case also the active part is not affected.

A substantial added advantage of the rotary locking cylinder according to the invention is that a unit construction system can be put together using the extension elements. With such a unit construction system the extension elements can be of varying length. Merely because of the different key shanks these can be constructed hierarchically. The rotatable inserts of the extension elements can also be profiled. The key shanks of the associated keys can be accordingly profiled. Compared to known profiling of armatures this means substantial rationalising. To construct a locking unit in the case of the inventive rotary locking cylinder the profile of the key and the length of the ineffective part of the key can be varied. The number of closings and thus the locking security can be increased accordingly with comparatively low additional costs.

According to another development of the invention the active part of the rotary locking cylinder is formed by a short cylinder. This short cylinder is preferably designed as an installation safety device.

The length of this short cylinder is such that it can be built into a lock case as an installation safety device without projecting at the sides. The active part of the rotary locking cylinder now sits protected in the lock and at least on the grip side can be covered by an extension element. If the extension element is manufactured partially or fully from hardened steel, then this gives a very high degree of protection against attack, since the active part is shielded by the extension element.

The invention also relates to a unit construction system with several rotary locking cylinders according to the present invention as well as a key for such a rotary locking cylinder. In the case of a key according to the invention there is the advantage that it can be profiled without considerable expense, making unauthorised copying difficult.

BRIEF DESCRIPTION OF THE DRAWINGS

An embodiment of the invention is explained in greater detail hereinbelow with reference to the diagram, in which.

Figure 1:
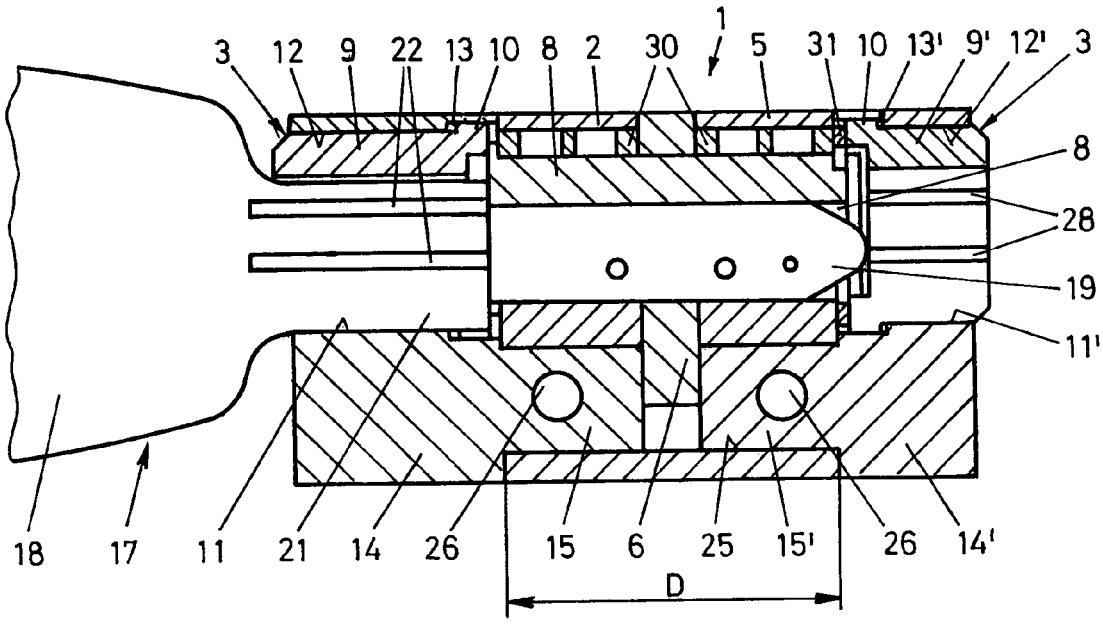
FIG. 1 is a section through a rotary locking cylinder according to the present invention.
Figure 2:
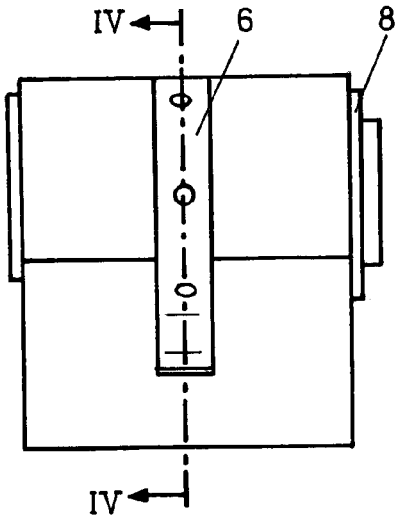
FIG. 2 is a view of a short cylinder without extension elements.

The rotary locking cylinder 1 shown in FIG. 1 is a double rotary locking cylinder and has an active part 2 as well as an extension element 3 and 3'. The active part 2 comprises a housing 5, in which several slides 30 for tumbler pins not illustrated here are inserted in a manner known per Se. Mounted in the housing is a driver 6 which can be rotated to actuate the lock after a rotor 8 is rotationally released. The rotor 8 may be a continuous rotor, as illustrated, or it can also comprise two rotor components in the usual manner. The rotor 8 is secured axially in the housing 5 by means of a circlip 31. The extension elements 3 and 31 each have a housing 14 or 14', and can be of different lengths. Machined into each housing 14 or 14' is a bore 12 or 12', into each of which is inserted a rotatable insert 9 or 9' from the rear. A radially protruding collar 10 of the insert 9 or 9' is mounted in a corresponding recess 13 or 13' of the rear side 24 or 24' of the housing 14 or 14'.

Formed on the rear side 24 or 24' of the housing 14 or 14' is a protruding cam 15 or 15' which engages in a corresponding recess 25 of the housing 5, as illustrated in FIG. 1. The cams 15 or 15' have a transverse bore 16, through which a pin 26 (FIG. 1) is inserted for fastening the housing 14 or 14' to the housing 5. This pin fastens each housing 14 or 14' to the housing 5. The extension elements 3 or 3' are thus connected rotatably to the housing components 5.

Figure 3:
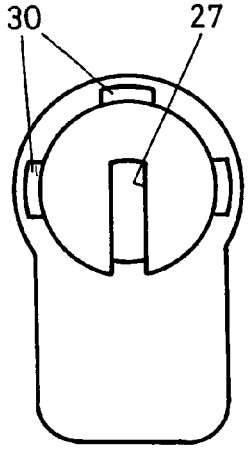
FIG. 3 is another view of the short cylinder as in FIG. 2.
Figure 4:
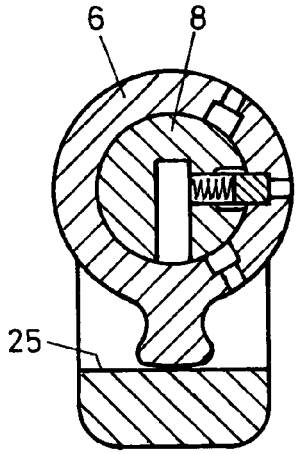
FIG. 4 is a section along line IV-IV.
Figure 5:
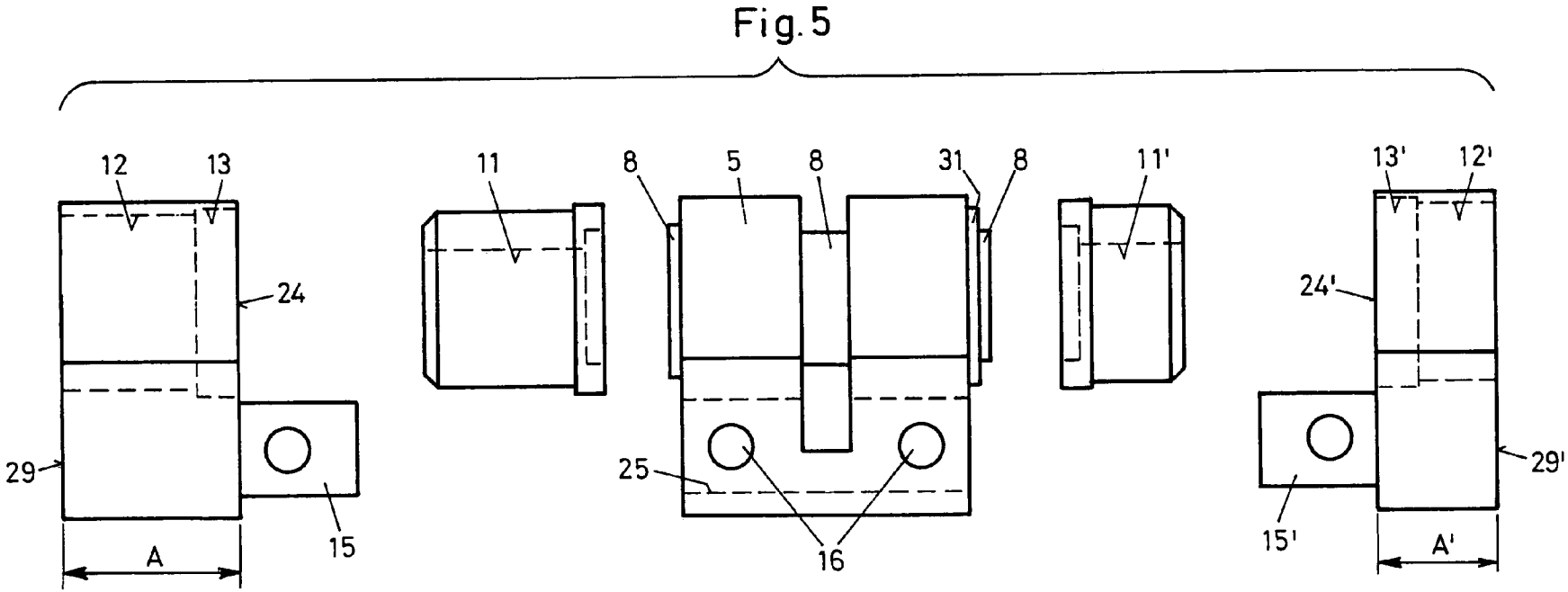
FIG. 5 is a view of the cylinder according to the present invention, with individual parts in an exploded view.

Machined into each insert 9 or 9' is a channel 11 or 11' which is designed to take up an extension part 21 of a key 17, with grip 18 and shank 19. This channel 11 or 11' is continuous and leads to a corresponding channel 27 (FIG. 3) of the rotor 8. The channels 11 are preferably profiled according to FIGS. 6*a* to 6*d* and have inwards protruding ribs 28 which are designed to correspond to grooves 22 of the key 17. A key 17 can be inserted fully into the channels 11 or 11' only if the extension part 21 has profiling 22 corresponding to the ribs 28. The profiling 28 can be designed variously, as clearly shown in FIGS. 6*a* to 6*d*. Such different profiling 28 enables a hierarchical structure of many keys 17 to 17''' of a locking unit, as likewise illustrated in FIGS. 6*a* to 6*d*.

DETAILED DESCRIPTION OF THE PREFERRED EMBODIMENTS OF THE INVENTION

The extension elements 3 or 3' each have a specific length A or A' which are determined by the distance between the inside 24 and outside 29. This length A or A' corresponds substantially to the length B of the extension part 21 shown in FIGS. 6*a* and 6*d*. The lengths A and correspondingly the lengths B can be different in a locking unit and a unit construction system, as evident in FIGS. 6*a* to 6*d*.

FIGS. 6*a* to 6*d* show only examples of possible profilings of a key 17. The grooves 22 can however be varied with respect to position and depth, as well as cross-section. The expert skilled in the art is aware of a multiplicity of such profilings. Also conceivable is a configuration in which the key 17 is not profiled in the extension part 21. The extension part 21 can also be varied in cross-section without profiling. For example, the part 21 can be of different widths with different keys. Consequently, the channels 11 of the associated rotary locking cylinder 1 are of different widths. The grooves 22 can extend also over the shank area 19 as per FIGS. 6*a* to 6*d*. The area 19 can thus also be profiled.

Figure 6A:
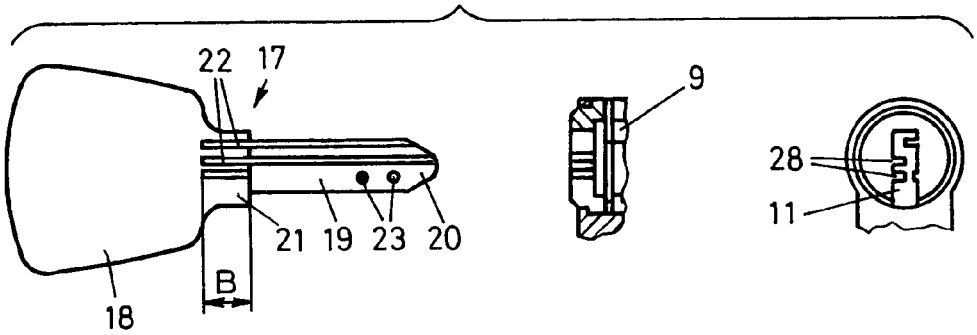
FIGS. 6*a* to 6*d* show different keys of an installation and corresponding extensions in section, as well as corresponding key channels.
Figure 6B:
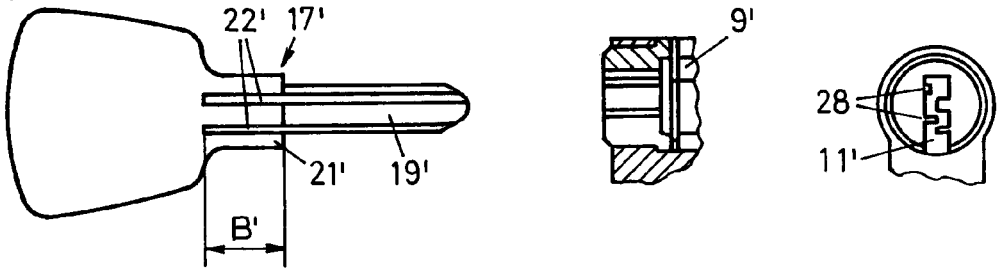
Figure 6C:
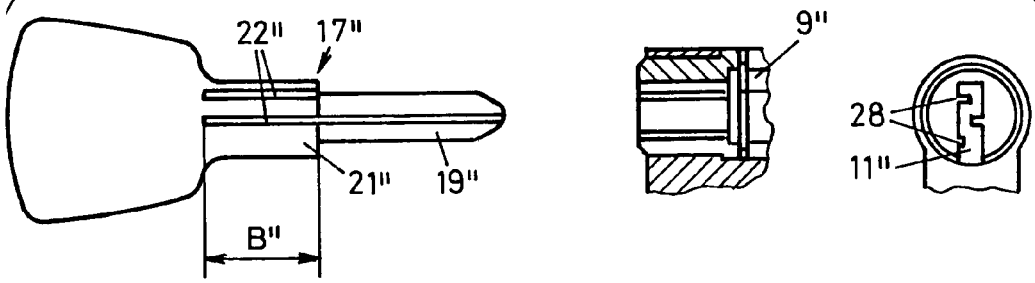
Figure 6D:
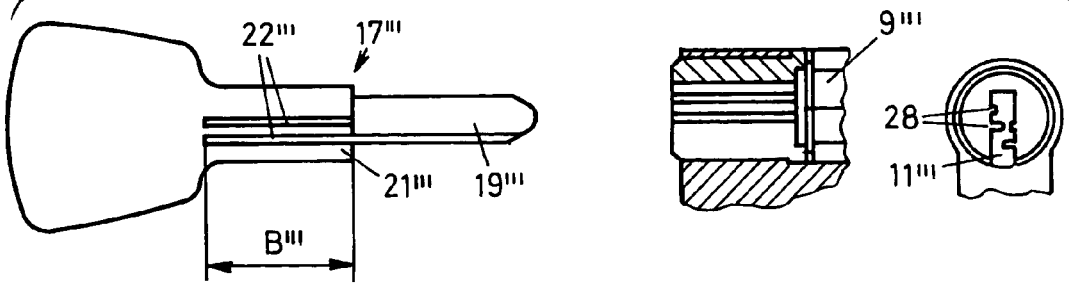

FIGS. 6*a* to 6*d* show keys 17 to 17''' of a locking unit. These keys 17 to 17''' differ at least in length of the extension part 21. These different lengths are designated in FIGS. 6*a* to 6*d* by B' to B'''. If a rotary locking cylinder now has an extension element 3, in which the length A is substantially equal to the length B, then this rotary locking cylinder can be operated using all keys 17 to 17'''. But should the extension element 3 now have length A, corresponding to length B'', then this rotary locking cylinder cannot be operated using the key 17 (FIG. 6*a*). This rotary locking cylinder can be operated using keys 17' to 17'''.

If another rotary locking cylinder has an extension element 3, in which the length A is equal to the length B''', then this rotary locking cylinder can be operated only with the key 17'''.

In this way a locking unit can be constructed simply due to the variation in length B. This locking unit can be expanded further by way of the abovementioned profiling.

FIG. 1 illustrates a rotary locking cylinder 1, as mentioned, in which the active part 2 is preferably a short cylinder.

The length D of this short cylinder 2 is substantially less than that of standard double rotary locking cylinders and corresponds substantially to the thickness of a customary lock case. The short cylinder 2 or the active part is extended at both ends in each case by an extension element 3 or 3'. The rotor 8 of the active part 2 is preferably continuous. In FIG. 1 the key 17 is inserted from the left side of the rotary locking cylinder 1 into the former. This key 17 can be used to coordinate the tumblers, not illustrated here, from the other side also.

The extension elements 9' to 9''' can each be combined also from several shorter elements. These elements have a thickness of 5, 10 or 15 mm for example and are placed in succession. Using just a few units allows a wide variety of lengths to be made up. This effectively simplifies parts stockage and manufacturing costs can be kept low. Because the short cylinder 2 already guarantees a high degree of locking safety, the extension elements 9' to 9''' can be manufactured from a cost-effective material, such as zinc, plastic or brass, for example.

The invention claimed is:

1. A rotary locking cylinder for a safety lock, comprising:

a first housing;

at least one rotor (8) having a key channel (27);

a driver (6) engaged around the at least one rotor (8) and having tumblers which rotationally release the at least one rotor (8) with a corresponding key (17), wherein the rotor (8) and driver (6) are both engaged within the first housing (5);

wherein the first housing forms an active part (2) of the rotary locking cylinder and has a first end and a second end facing away from the driver (6);

a second housing (14) having a rotatable insert (9) forming a first extension element (3);

wherein the first extension element (3) is fixed on the active part (2) a distance apart from the driver (6) on the first end of the active part (2) and a key shank of the corresponding key is extended substantially corresponding to a length (A) of the first extension element (3);

wherein the rotatable insert (9) of the first extension element (3) extends out from the first end of the rotor (8); and wherein the second housing (14) of the first extension element (3) also extends out from the first end of the first housing (5).

2. The rotary locking cylinder as claimed in claim 1, wherein the rotatable insert (9) of the first extension element (3) is profiled.

3. The rotary locking cylinder as claimed in claim 2, wherein the rotatable insert (9) of the first extension element (3) and/or the second housing (14) of the first extension element (3) is manufactured from a hard or cost effective material.

4. The rotary locking cylinder as claimed in any one of claims 1, 2 or 3, wherein the active part (2) is formed by a short cylinder with a continuous rotor (8) which can be operated from both sides.

5. The rotary locking cylinder as claimed in claim 3, wherein the hard material is hardened steel or a hard metal.

6. The rotary locking cylinder as claimed in claim 3, wherein the cost effective material is zinc, plastic or brass.

7. The rotary locking cylinder as claimed in claim 1, wherein the rotary locking cylinder is provided at the second end with a second extension element (3').

8. The rotary locking cylinder as claimed in claim 7, wherein a plurality of the rotary locking cylinders form a unit construction system, wherein the length (A) of respective first extension elements (3) of each of the plurality of rotary locking cylinders and a corresponding length (B) of each of the corresponding keys (17) are different.

9. The rotary locking cylinder as claimed in claim 8, wherein shanks (19) of each of the corresponding keys (17) have an active part (20) with bores (23) and another part (21) corresponding to the length (A) of the first extension element (3), wherein another part corresponding to the length (A) of the first extension element (3) is arranged between the active part with bores and a key grip.

10. The rotary locking cylinder as claimed in claim 8 or 9, wherein each of the rotatable inserts (9) of the first extension elements (3) are profiled differently.

11. The rotary locking cylinder as claimed in claim 8, wherein each of the rotatable inserts (9') of a second extension element (3') are of varying length.

12. The rotary locking cylinder as claimed in claim 1, wherein a shank (19) of the key has a front active part (20) and an extension part (21) between the front active part (20) and a key grip (18).

13. The rotary locking cylinder as claimed in claim 12, wherein the extension part (21) is wider than the front active part (20).

14. The rotary locking cylinder as claimed in claim 12 or 13, wherein the extension part (21) is profiled.

15. The rotary locking cylinder as claimed in claim 14, wherein the extension part (21) is profiled in the longitudinal direction of the shank (19).

16. The rotary locking cylinder as claimed in claim 14, wherein the extension part (21) has grooves (22) running in the longitudinal direction of the shank (19).

* * * * *